United States Patent [19]

Kunsman

[11] 3,995,466

[45] Dec. 7, 1976

[54] MACHINE FOR ROLL GROOVING OF PIPE

[75] Inventor: Donald R. Kunsman, Easton, Pa.

[73] Assignee: Victaulic Company of America, South Plainfield, N.J.

[22] Filed: Sept. 19, 1975

[21] Appl. No.: 614,973

[52] U.S. Cl. ..... 72/106; 72/105; 72/465

[51] Int. Cl.[2] ..... B21D 19/06

[58] Field of Search ..... 72/105, 106, 107, 108, 72/109, 110, 179, 465; 269/310

[56] References Cited

UNITED STATES PATENTS

| | | | |
|---|---|---|---|
| 1,186,145 | 6/1916 | Stowe | 72/106 |
| 2,506,657 | 5/1950 | Webster | 72/109 |
| 3,230,606 | 1/1966 | Saito et al. | 72/108 |
| 3,435,651 | 4/1969 | McInnis | 72/105 |
| 3,548,623 | 12/1970 | Hess et al. | 72/106 |

*Primary Examiner*—Lowell A. Larson
*Attorney, Agent, or Firm*—Brooks Haidt Haffner & Delahunty

[57] ABSTRACT

A machine for semi-automatic grooving of pipe, capable of high output of full or less than full lengths of pipe with uniform external circumferential grooves, has supporting idler rolls for automatic positioning of the pipe axis at a small angle of deflection to draw the pipe end in as grooving progresses, with respect to a driven backup roll and a freely rotatable grooving roll. Pipe vibration during rotation is damped by hydraulic means. An adjustable groove depth control and a safety mechanism are also provided.

14 Claims, 14 Drawing Figures

20
19
35
68
66
57
36
60
34
32
25
34
11
23
26
22
21
12
13
50b
51b
14
46
46
51a
50a
50
51
H
43
54
49
49
15
48
48
53
27
49
49
47

P

P
G

H
35
36
34
11
32
26
16
30
12
28
13
50
31
14
46
70
55
54
F
15
E
53
27

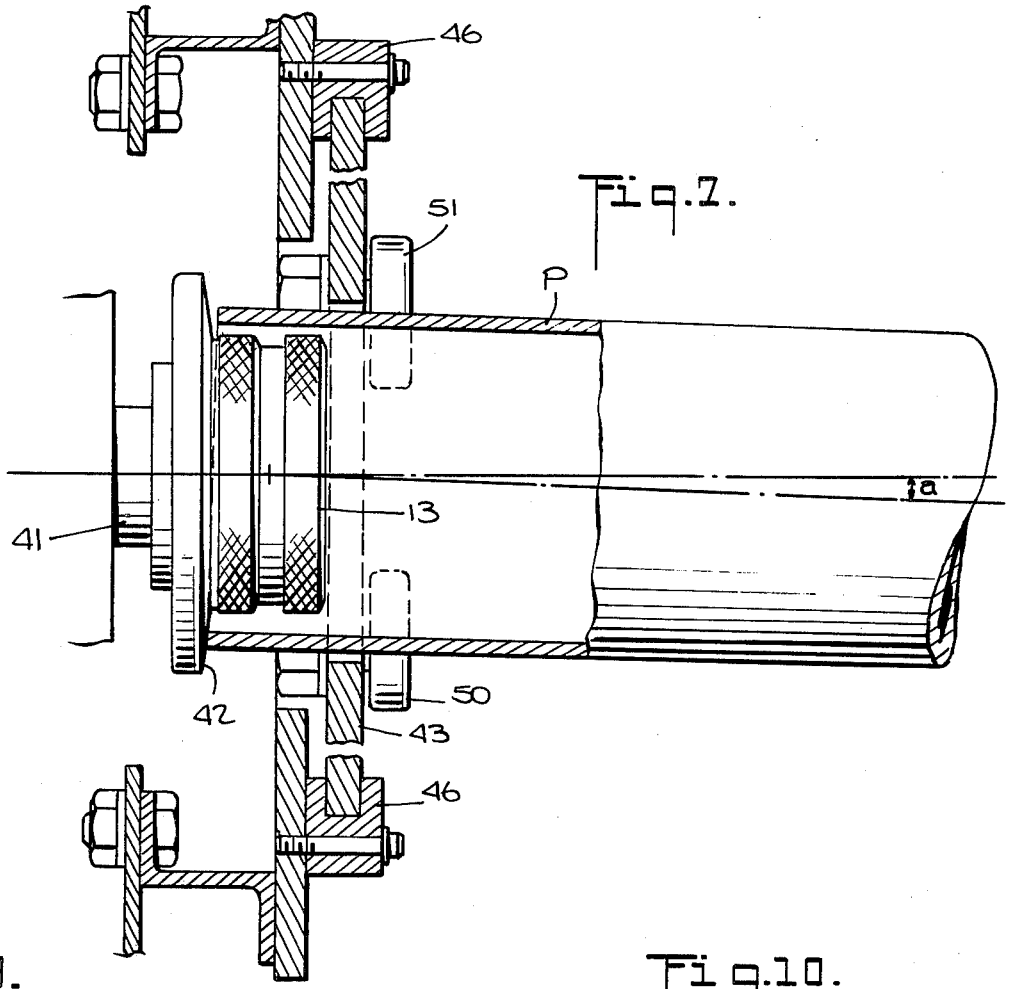
Fig. 7.
Fig. 9.
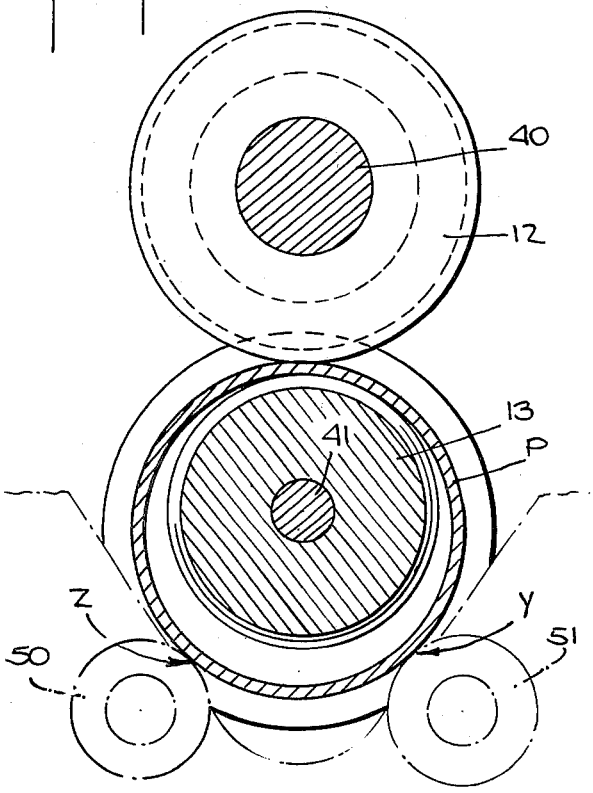
Fig. 10.
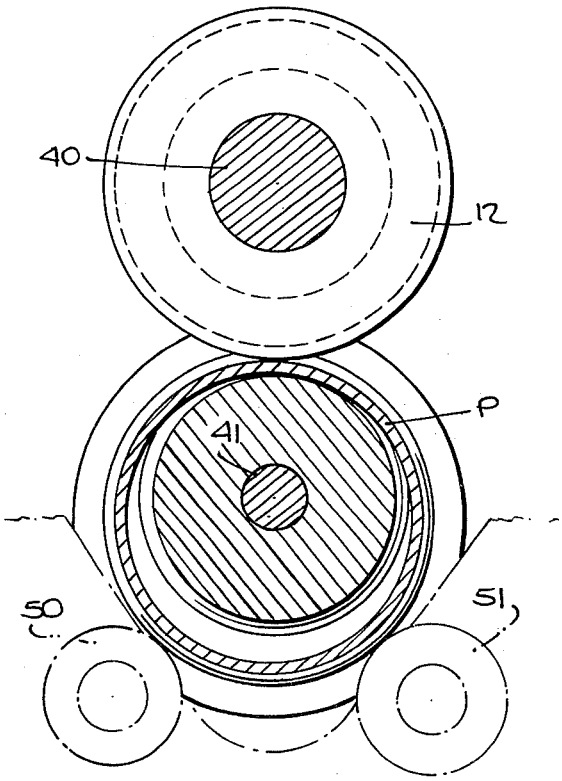

12
13
14
45
45
46
46
50
50a
50b
51
51a
51b
P
43
44
48
48
49
49
53

MACHINE FOR ROLL GROOVING OF PIPE

BACKGROUND OF THE INVENTION

1. Field of the Invention

The invention relates to a roll grooving machine for pipe, and more particularly to a semi-automatic roll grooving machine for production of grooved pipe in semi or full production quantities.

2. Description of the Prior Art

A popular system of piping uses couplings that interfit with circumferential grooves at the ends of opposed pipe sections.

U.S. Pat. Nos. 2.975,819 and 3,015,502 relate to roll grooving tools for providing external circumferential grooves. These patents are assigned to the assignee of the present application.

More recently, the commonly assigned U.S. Pat. No. 3,903,722 of Thau and Coughlan, filed June 28, 1974, and entitled Roll Grooving Tool, describes a roll groover with semi-automatic feed that employs an hydraulic piston and cylinder assembly to apply controlled grooving force against a pipe wall.

SUMMARY OF THE INVENTION

The roll grooving machine of the present invention is equipped for the production of uniform circumferential grooves in Pipe Mill or shop production quantities of full, or partial, pipe lengths with end grooves. While there are certain mechanical principles and structural features in common with the portable tool of the commonly assigned U.S. Pat. No. 3,903,722, the tool of the present invention also incorporates new features to provide the greater control required for uniform grooving, in volume, of full or partial lengths of pipe. The pertinent disclosure of the aforesaid U.S. Pat. No. 3,903,722 is hereby expressly incorporated herein by reference.

A motor of the tool is connected by a main drive shaft to a backup roll for engaging the inner wall of a pipe to be grooved. The pipe end is supported from the outside by supporting idler rolls of mutually different diameters. The pipe end is supported on the backup roll and urged inward towards a flange on the backup roll and kept against the flange by an automatic positioner during grooving operation.

The idler rolls are themselves mounted on a vertically movable vibration eliminating assembly to cushion against vibration in case the pipe is out of round or bent along its length. This vibration eliminator assembly is coupled to an hydraulic piston and cylinder for controlled downward motion under force from the pipe.

To press the grooving roll against the pipe wall from above, the machine has a top ram powered by an hydraulic piston that is stronger than that of the vibration eliminator. Accordingly the ram always overpowers the vibration eliminator under conditions requiring that something has to give during roll grooving, e.g., the rotation of the pipe off-center.

An adjustable groove depth control of the machine can be set to stop automatically and return the grooving roll to an elevated position out of contact with and to clear the O.D. of the pipe when a preset groove depth on the depth control has been reached. The depth control is also provided with a time delay element allowing the grooving roll to dwell for a certain time after achievement of the present groove depth to assure uniform accuracy of depth about the whole pipe circumference.

A photocell activated safety device operative to prevent the ram from driving down when no pipe is in grooving position is another feature of the preferred embodiment of the invention.

Speed control and pressure control are provided, and the machine is capable of versatile operation in providing grooves of desired shape and depth in pipes of different sizes, wall thickness and materials.

These and other features of the invention will be more fully understood from the following detailed disclosure of a presently preferred embodiment of the machine, especially when that description is read with reference to the accompanying figures of the drawing.

BRIEF DESCRIPTION OF THE DRAWING

In the drawing, in which like reference characters designate like parts throughout.

FIG. 7, taken along the line 7—7 of FIG. 5, shows the action of the supporting idler rolls in automatically positioning the pipe at an angle to the machine grooving roll;

FIGS. 9 and 10, taken along lines 9—9 of FIG. 5 and 10—10 of FIG. 6, show the pipe and rolls at a plane defined by the position of the pipe groove;

DETAILED DESCRIPTION OF A PREFERRED EMBODIMENT

Figures 1, 2, 3:
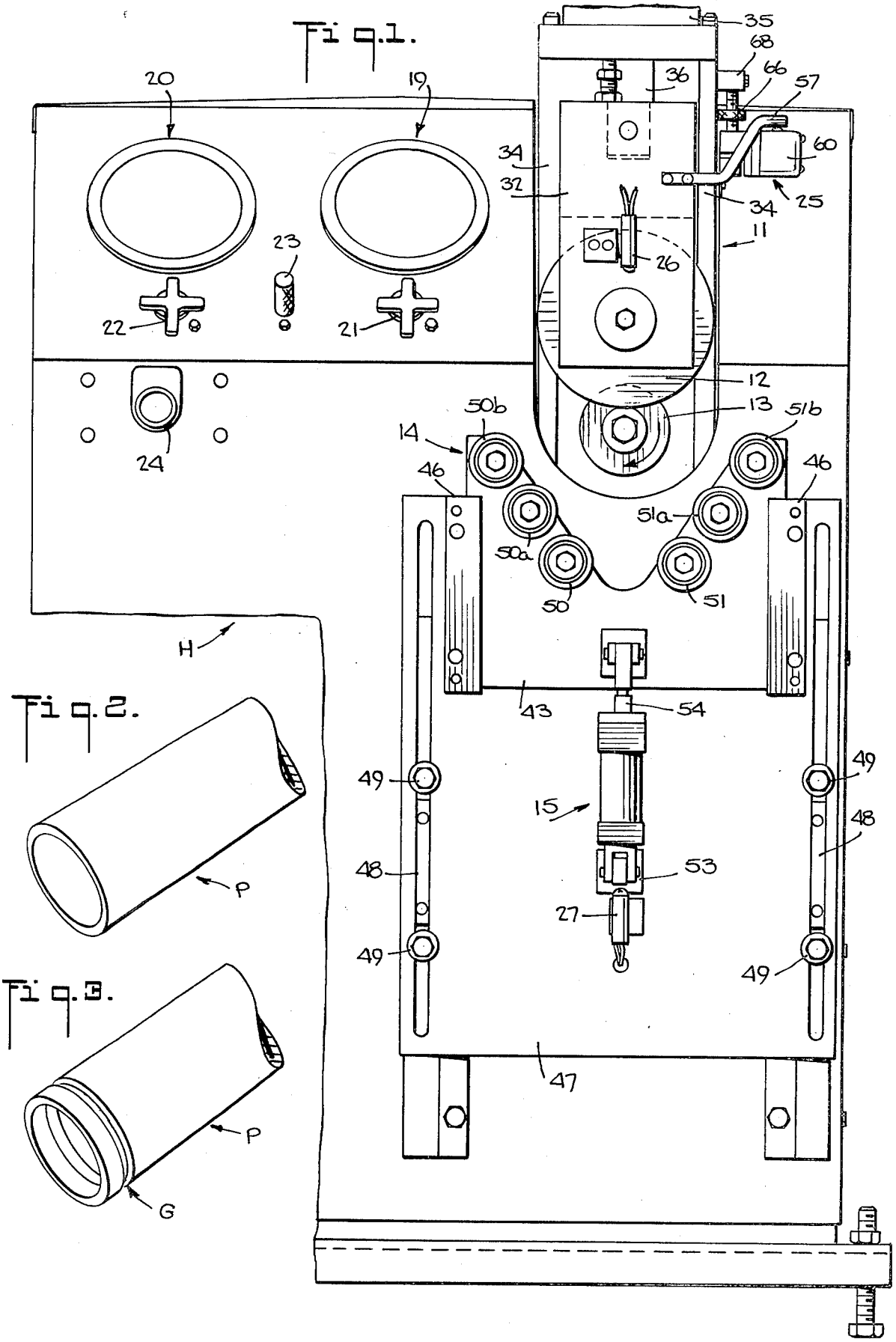
FIG. 1 is a front view, partially broken away, of a machine according to the invention.
FIG. 2 shows a plain pipe end.
FIG. 3 shows the pipe end of FIG. 2 with an external circumference groove formed therein.
Figure 4:
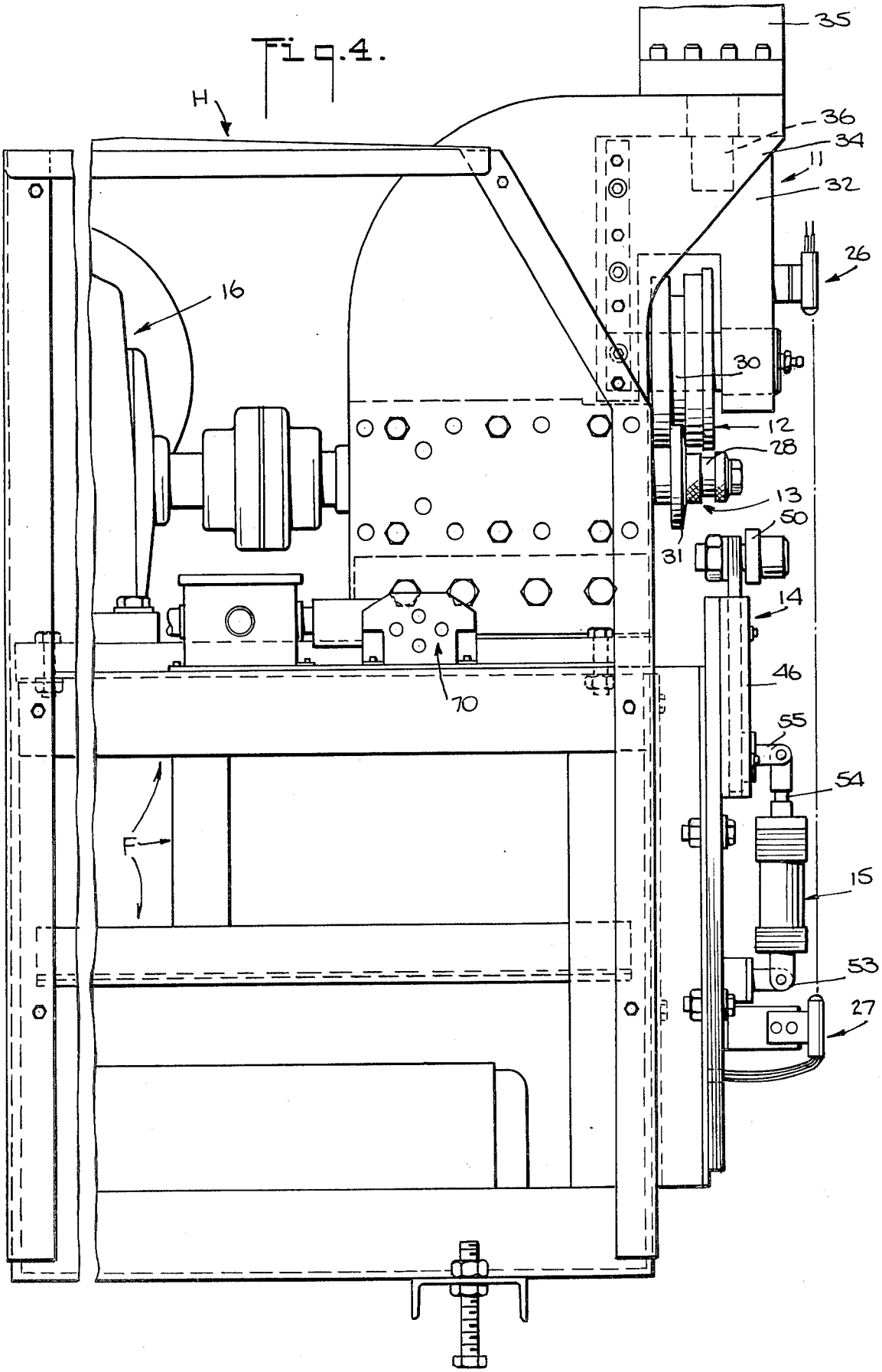
FIG. 4 is a side view, partially broken away, of the machine of FIG. 1, with a side panel removed to show some internal parts.
Figure 5:
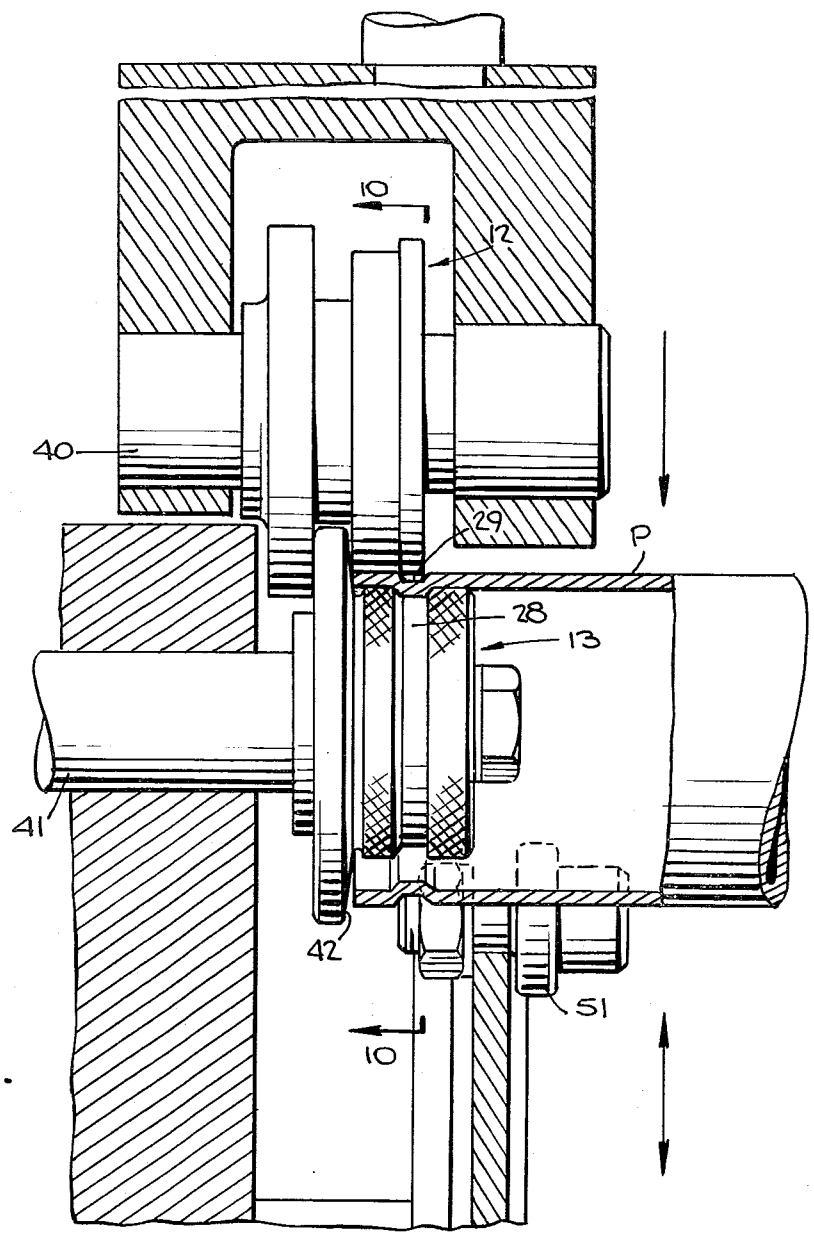
FIG. 5 is a view partly in section illustrating the grooving and backup rolls with a pipe end therebetween, as at the start of rolling a groove.

The front and side views of FIGS. 1 and 4 respectively show the machine of the invention with no pipe in grooving position. The top ram assembly generally designated by reference numeral 11 is mounted to be forced downward by hydraulic cylinder means, and carries a grooving roll 12 for rolling a groove in a pipe between the said grooving roll 12 and a mating driven backup roll 13.

When a pipe end is in place between the rolls 12 and 13 for rolling in a groove, the pipe is supported and guided by automatic angle positioning means generally designated 14. The means 14 is equipped with a vibration eliminating device 15 in the form of an hydraulic piston and cylinder to initially position the pipe end relative to the support roll O.D. and to allow some vertical movement of the means 14 in response to vibration due to irregularities in pipe being grooved and the like.

Comparison of FIGS. 1 and 4 will show that a motor 16 for driving the backup roll 13 is mounted on sturdy structural frame members F (FIG. 4) within a housing or enclosure H of the machine. Reference numerals 19 and 20 in FIG. 1 generally designate hydraulic pressure gauges to show the pressure on the top ram 11 and vibration eliminating cylinder 15. A valve handle 21 is associated with gauge 19 and a handle 22 with gauge 20 for setting the respective pressures, and a speed control 23 for the top ram 11 is also illustrated. Preferably an emergency stop control 24 is positioned near the other controls just mentioned.

At the upper right in FIG. 1 there is shown an adjustable groove depth stop device 25. The elements generally designated 26 and 27 in FIGS. 1 and 4 are respectively a light source and a photoelectric cell comprising a safety mechanism for preventing the ram 11 from operating when there is no pipe in position for grooving.

Various features of the machine will be more fully described in conjunction with the other drawing figures. The foregoing overall description shows that while the operating principle and some basic features of this machine are like those of the tool described in U.S. Pat. No. 3,903,722, the machine of the invention has additional features related to maintaining the control desired for high output grooving of lengths of pipe.

For example, the grooving roll 12 and backup roll 13 employed in the machine of the present invention correspond in structure and function to the backup and grooving rolls of said U.S. Pat. No. 3,903,722, having a contoured groove 28 and grooving flanges 29 respectively for rolling into a pipe wall a groove that is optimally shaped for the reception of an external coupling housing. A groove 30 and tongue 31 interfit between the rolls 12 and 13, in accordance with U.S. Pat. No. 3,903,722, is also preferably provided for mating alignment of the rolls.

The top ram assembly 11 of the machine of the invention is also similar to structure shown in U.S. Pat. No. 3,903,722, in that a pair of spaced parallel arm portions 34 embrace the housing element 32 of the top ram 11 for sliding vertical movement of the housing element 32, which sliding movement can be guided by rails in accordance with the teachings of the said U.S. Pat. No. 3,903,722. The arrangement of a hydraulic cylinder at 35 with its piston 36 secured to the housing element 32 is somewhat similar to that of U.S. Pat. No. 3,903,722, except that in the machine of the present invention the cylinder and piston 35, 36 are of the double-acting type for powered retraction of the top ram housing element 32 when a groove has been completed. This use of a double-acting mechanism is more suited to high volume operation, and requires a different depth stop arrangement from that of the prior art.

Various features such as those just mentioned have beend disclosed by the prior art and need not be discussed in detail, but have been illustrated in the drawing for purposes of completeness in such manner as to be fully understood by those acquainted with modern roll grooving techniques and equipment. The end of a plain end pipe P as shown in FIG. 2 is, in accordance with the invention, accepted between the rolls 12 and 13 and a groove G, extending uniformly around the circumference of the pipe P, is rolled into the exterior of the pipe wall to produce a grooved end pipe as shown in FIG. 3. Those familiar with the art know that for certain kinds of pipe, the rolling of a groove is preferable to cutting of a groove and the consequent reduction of pipe wall thickness that results when material of the pipe wall is cut away.

AUTOMATIC ANGLE POSITIONING

Figure 6:
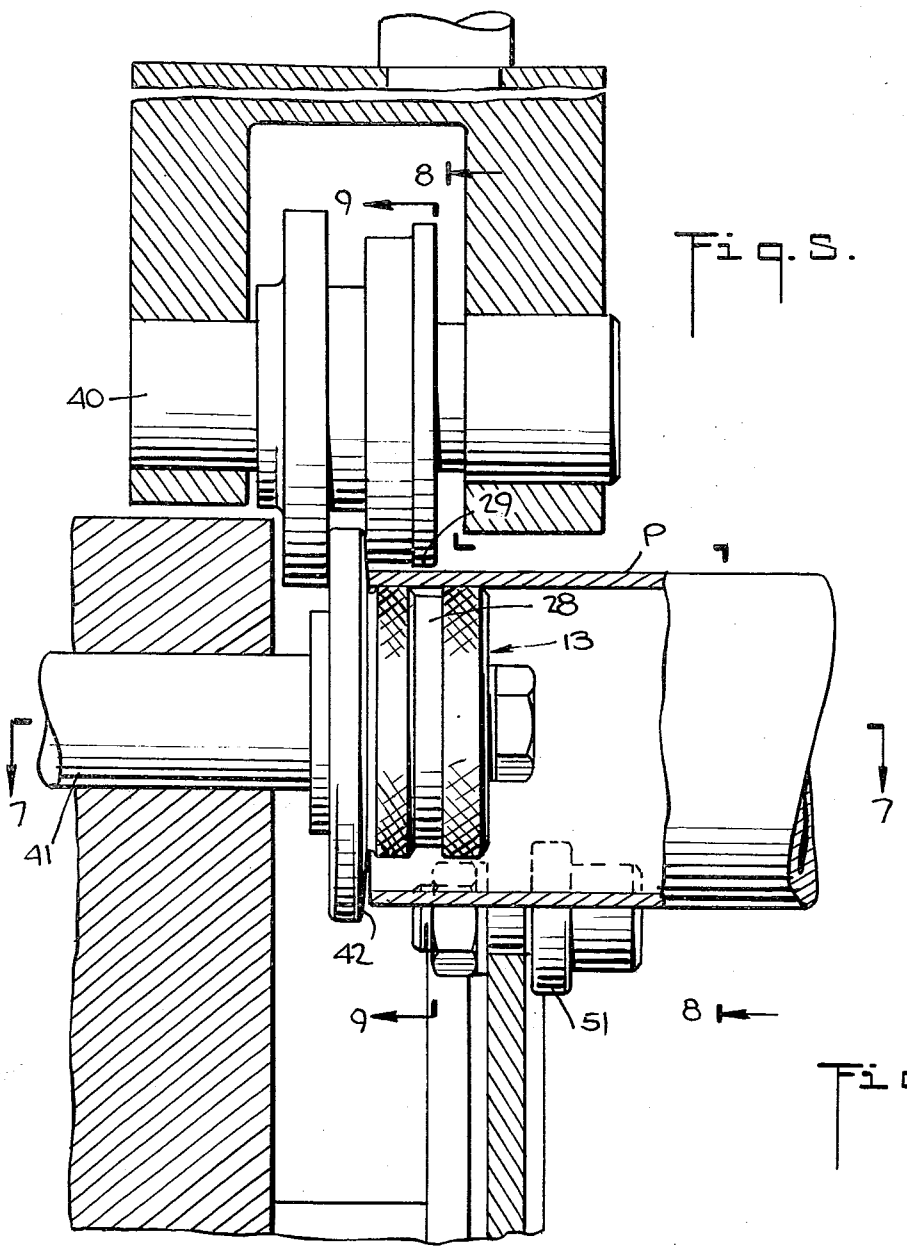
FIG. 6 shows the relative positions of the parts shown in FIG. 5 when a groove has been rolled.

In the operation of the machine of the present invention, the downward movement of the housing element 32, under the action of the hydraulic piston 36, forces the grooving roll 12 down towards the backup roll 13. FIGS. 5 and 7–9 show the relative positions of the pipe and rolls at the beginning of the rolling operation when the grooving flange 29 of the grooving roll 12 has just been brought into contact with the wall of a pipe P. FIGS. 6 and 10 show the relative positioning of the pipe and rolls at the completion of rolling of a groove of the desired depth in the pipe P. In the drawings, the freely rotating axial shaft 40 of the grooving roll 12 and the driven axial shaft 41 of the backup roll 13 are seen to remain mutually parallel as the shaft 40 is moved downward toward the shaft 41 in a plane defined by the axes of the shafts 40, 41. As in the tool of U.S. Pat. No. 3,903,722, a slightly tapered surface 42 of the flange 31 on the backup roll 13 serves as an end stop against which the end of a pipe P is thrust for engagement of the pipe wall between the grooving flange 29 and the backup roll 13.

The proper roll grooving of pipe ends requires the pipe P to remain in a constant linear position relative to the rolls 12 and 13 during the grooving operation, and therefore there should be a means for forcing the pipe end against the end stop surface 42. It has been determined that an approximate 1° deflected angle of the pipe axis relative to the axis of the backup roll 13 accomplishes this positioning. In U.S. Pat. No. 3,903,722, an angle of about one-half degree was mentioned in this connection, and it was suggested that the tool operator should manually move the pipe to achieve such deflection, or that a pipe stand positioned slightly off-center be employed.

Figure 8:
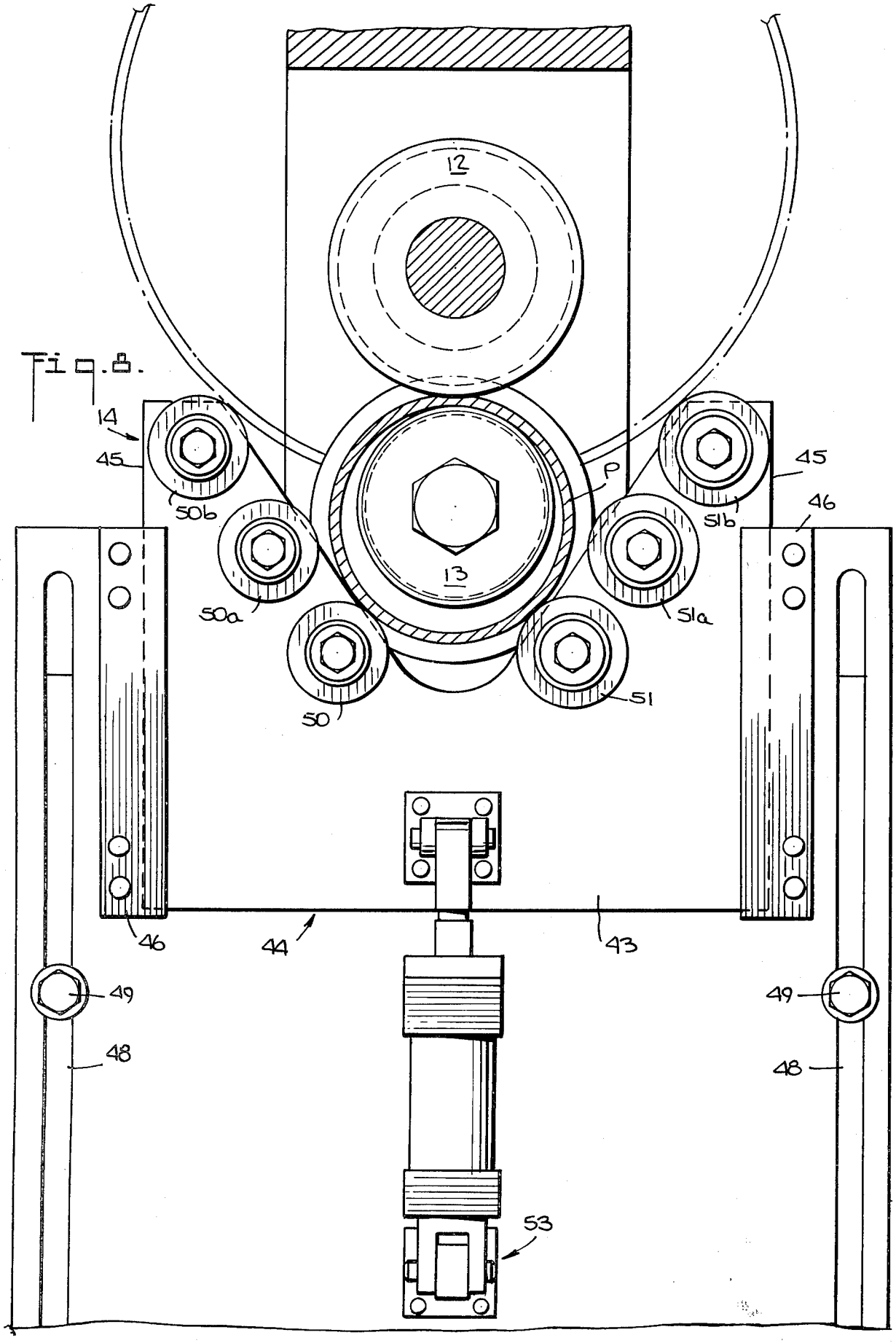
FIG. 8 is a front view, partly in section, with dashed lines indicating concealed parts, taken along line 8—8 of FIG. 5 and showing the hydraulic piston and cylinder of the vibration eliminating means.

In accordance with the present invention, the proper angle of presentation of a pipe end to the machine is maintained automatically by the means 14 built into the machine. Referring more particularly to FIG. 8 it will be seen that a pipe P is in roll grooving position between the rolls 12 and 13 and that the automatic angle positioning means generally designated 14 is supporting the pipe P.

The positioning means 14 comprises a plate 43 having a straight horizontal bottom edge 44 and vertical side edges 45. The side edges 45 of the plate 43 fit slidably within vertical guide members 46, and the guide members 46 are themselves secured to a support member 47. The support member 47 is flat and has vertical slots 48 at its sides through which the bolts 49 extend to secure the support member 47 at a selected height to the front of the machine housing H. It will be seen that the vertical position of the support member 47 is adjustable.

To receive a pipe P the plate 43 of the positioning means 14 has an upwardly opening V-shaped recess as shown best in FIGS. 1 and 8. This V-shape will accomodate pipes of a wide range of outside diameters, a relatively small pipe P being shown in the drawing. The pipe wall does not rest directly upon the plate 43 but is supported by a pair of idler rolls 50 and 51 that are rotatably mounted on studs projecting forward from the plate 43 as best shown in FIGS. 4 and 8. These idler rolls 50, 51 permit the pipe P to turn freely about its axis as a groove G is rolled into the pipe by the grooving rolls 12 and 13. The parallel, horizontally directed axes about which the rolls 50 and 51 turn are equidistant from the vertical bisector of the V-shaped recess as shown in FIGS. 7–10, but the idler rolls 50 and 51 are not identical.

The idler roll 51 is slightly larger in diameter than the idler roll 50. For example, if the diameter of the idler roll 51 is (2in.), the idler roll 50 preferably has a diameter of 1⅞ inches. Thus the roll 51 overlies the V-shaped recess to a greater extent than does the roll 50, as shown best in FIGS. 7–10.

Attention is directed to FIG. 9 wherein it is seen that the idler roll 51 contacts the outside wall of the pipe P at a point Y and the roll 50 contacts the pipe wall at point Z. It will be noted that the axes of rotation of the rolls 50 and 51 are equally horizontally spaced from the vertical bisector of the V-shaped recess, and that the said vertical bisector runs through the axes of rotation of both grooving roll 12 and backup roll 13. However, the point Z is a slightly greater distance from this bisector line and from the axes or rotation of the backup roll. The effect of this difference in size of the rolls 50 and 51 is illustrated in FIG. 7, wherein the pipe p is seen to be deflected at a slight angle *a*, which is the desired angle of deflection to keep the pipe P up against the end stop surface 42 during grooving.

In other words, the pipe is caused to sit off-center relative to the grooving and backup rolls 12 and 13. Because the pipe P is engaged by the rolls 12 and 13 closer to the pipe end than the location of the idler rolls 50 and 51, the rolls 12 and 13 pull the pipe P back toward a centered position, and in doing so, the rolls 12 and 13 cause the axis of the pipe P to be deflected by the angle *a* as shown in FIG. 7. This deflection causes the pipe P to be constantly drawn inward as grooving pressure is applied a fixed distance from the pipe end to form the uniform concentric groove G. In the embodiment of the machine shown, the driven backup roll 13 is rotated clockwise as shown in FIG. 1. Thus the forces acting on the pipe idler rolls 50 and 51, spaced some distance down the pipe length from the grooving roll 12 and backup roll 13, impart the desired deflection to the pipe. If the pipe were driven to rotate counterclockwise, the rolls 50 and 51 would have to be reversed in location. As seen in FIG. 10, illustrating a condition at which the groove G has been formed, the described deflection of the pipe continues throughout the grooving operation.

Since the machine of the invention is intended for use in rolling grooves in pipes of different sizes, a plurality of pairs of idler rolls for supporting and causing the slight deflection of the pipe is provided. Thus the figures of the drawing show pairs of idler rolls 50*a*, 51*a* and 50*b*, 51*b* corresponding in size and function to the rolls of the pair 50, 51. That is, roll 51*a* is mounted parallel to, and is slightly larger in diameter than, roll 50*a*, and the rolls 51*b* and 50*b* have the same relationship. The rolls 50*a* and 51*a* are positioned higher up along the V-shaped recess to support a pipe of larger diameter than the pipe P shown in the drawing, but the action of the idler rolls 50*a*, 51*a* is the same as of the rolls 50, 51 just described. The pair of rolls 50*b*, 51*b*, is positioned to accommodate the largest diameter pipe to be grooved.

The automatic angle positioning arrangement shown and described avoids the necessity of manual deflection of the pipe by a machine operator, and causes the pipe always to assume the correct angle of presentation for uniform rolling of a groove.

ELIMINATION OF VIBRATION

The pipe to be grooved by means of the machine of the present invention need not be prefectly regular. The end of the pipe must be "square cut", and the pipe should be prepared by cleaning off coarse scale, dirt or other material before insertion of the pipe into the machine for grooving, but even when these preparations have been done, the pipe may be slightly irregular. For example the pipe may be somewhat bent along its length, or may be flattened out of true circular cross-section. There may be a seam weld on the pipe wall at the pipe end to be grooved. Any of the foregoing conditions could cause the pipe to "whip" and vibrate if the grooving rolls applied unrelieved constant force on the rotating pipe.

To cushion against the effects of pipe irregularities the machine is equipped with the vibration eliminating hydraulic piston and cylinder 15. As shown in FIGS. 1, 4 and 8, the lower end of the hydraulic cylinder 15 is secured by a pivot mounting 53 to the support member 47 at the lower front of the machine. The piston 54 of the cylinder 15 is pivotally secured by a clevis mounting 55 to the vertically slidable plate 43 on which the idler rolls 50, 51 are mounted. Thus the cylinder 15 is operative to move the rolls 50, 51 up or down in response to fluid pressure.

It has been noted that the top ram 11 is driven by thy hydraulic cylinder and piston 35, 36. A single pump can be employed to provide the fluid pressure for both cylinders 15 and 35, preferably in a circuit which will be described in connection with FIG. 14. The cylinder 35 of the top ram 11, which supplies the force used to roll a groove in the pipe, is considerably larger than the cylinder 15, and accordingly always overpowers the vibration eliminating cylinder 15. The piston 54 will thus retract downward whenever an increased load is imposed on the idler rolls 50, 51. Such an increase in the load occurs when an irregularity in the pipe P passes between the grooving and backup rolls 12 and 13. The vibration eliminating cylinder "gives" to an extent sufficient to relieve the extra load. As an example the cylinder 35 that operates the top ram 11 can be a four inch diameter cylinder, when the cylinder 15 is of one inch diameter. The pump for both cylinders and the related hydraulic power elements can be housed within the machine housing H, for easy monitoring and control by the means generally shown at 19–22 in FIG. 1.

GROOVE DEPTH CONTROL

Figure 11:
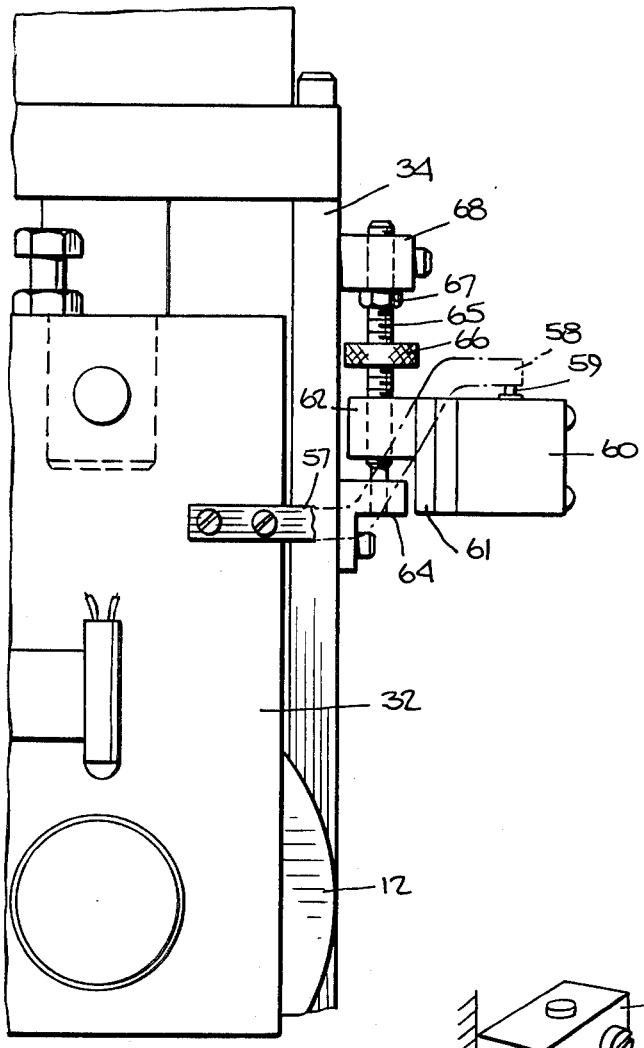
FIG. 11 is a front view in detail of the depth stop assembly.
Figure 12:
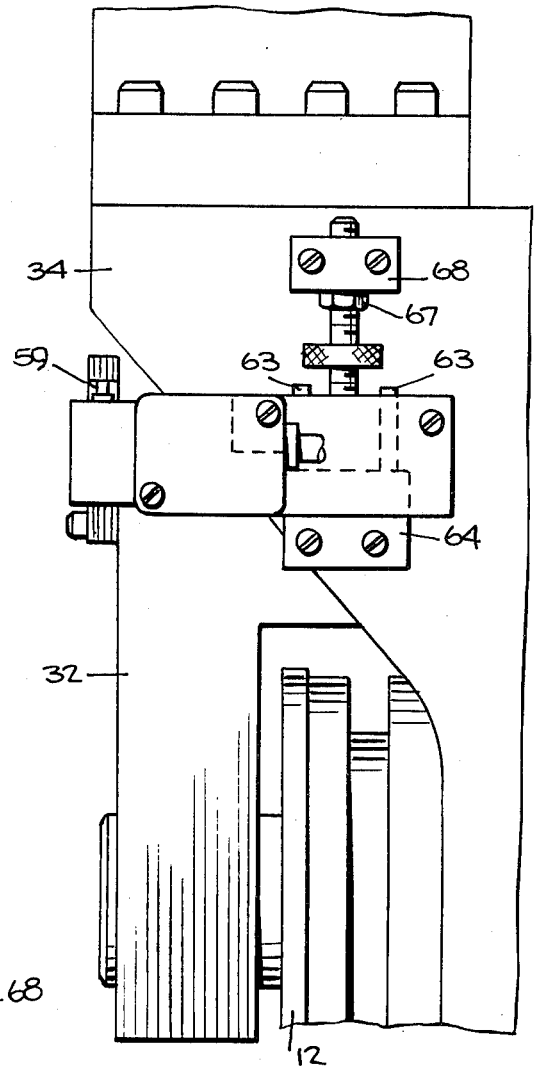
FIG. 12 is a side view in detail of the assembly of FIG. 11.
Figure 13:
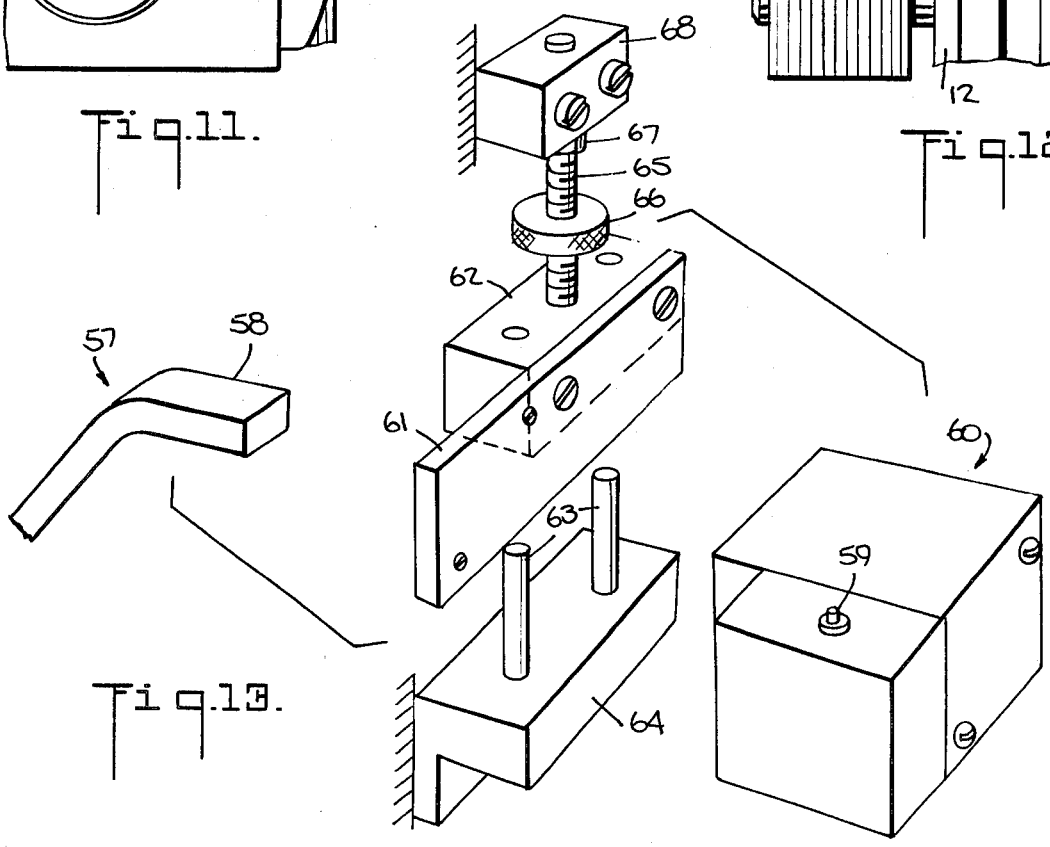
FIG. 13 is an exploded view of the assembly of FIGS. 11 and 12 in perspective.

The automatic groove depth stop generally designated 25 in FIG. 1 is shown in detail in FIGS. 11, 12 and 13. A rigid bar 47 is secured at one end to the housing 32 of the top ram assembly 11. The bar 57 extends outward and upward past the front one of the arms 34 and the free end 58 of the bar 46 lies directly above a button 59 of a depth control switch S in a box 60. The box 60 that houses the switch is mounted on a plate 61 secured to a guide block 62. Vertical holes through the guide block 62 slidably receive dowel pins 63 that extend upward from an angle piece 64, and the angle piece 64 is firmly secured to the arm 34 as best shown in FIGS. 11–13. The vertical position of the box 60 and accordingly of the button 59 is adjustable by means of a threaded rod 65 extending through the guide block 62. The depth stop rod 65 is provided with a knurled knob 66 for easy manual adjustment of the vertical location of the button 59. After adjustment the depth stop is locked in place by means of a nut 67 which is tightened up against a top support block through which the upper end of the threaded bar 65 extends.

The operation of the depth stop assembly 25 is as follows. With the top ram housing element 32 in its elevated position, i.e., with the piston 36 retracted fully upwards, the distance the piston 36 must descend is equal to the distance from the grooving flange 29 of the roll 12 to the outer wall of a pipe P resting on the backup roll 13 plus the desired depth of the groove G to be rolled into the pipe P.

The position of the box 60 is accordingly adjusted so that the bar 46 must descend the desired distance before the button 59 is depressed and the switch S activated. The switch S is electrically connected to a time delay relay that allows the grooving roll 12 to dwell for a predetermined time. This dwell of the roll 12 at its lowest position while the pipe P continues to rotate under the influence of the driven backup roll 13 assures uniform groove depth around the pipe circumference. The top ram housing element 32 and roll 12 are then retracted upward by the return of the piston 36.

Figure 14:
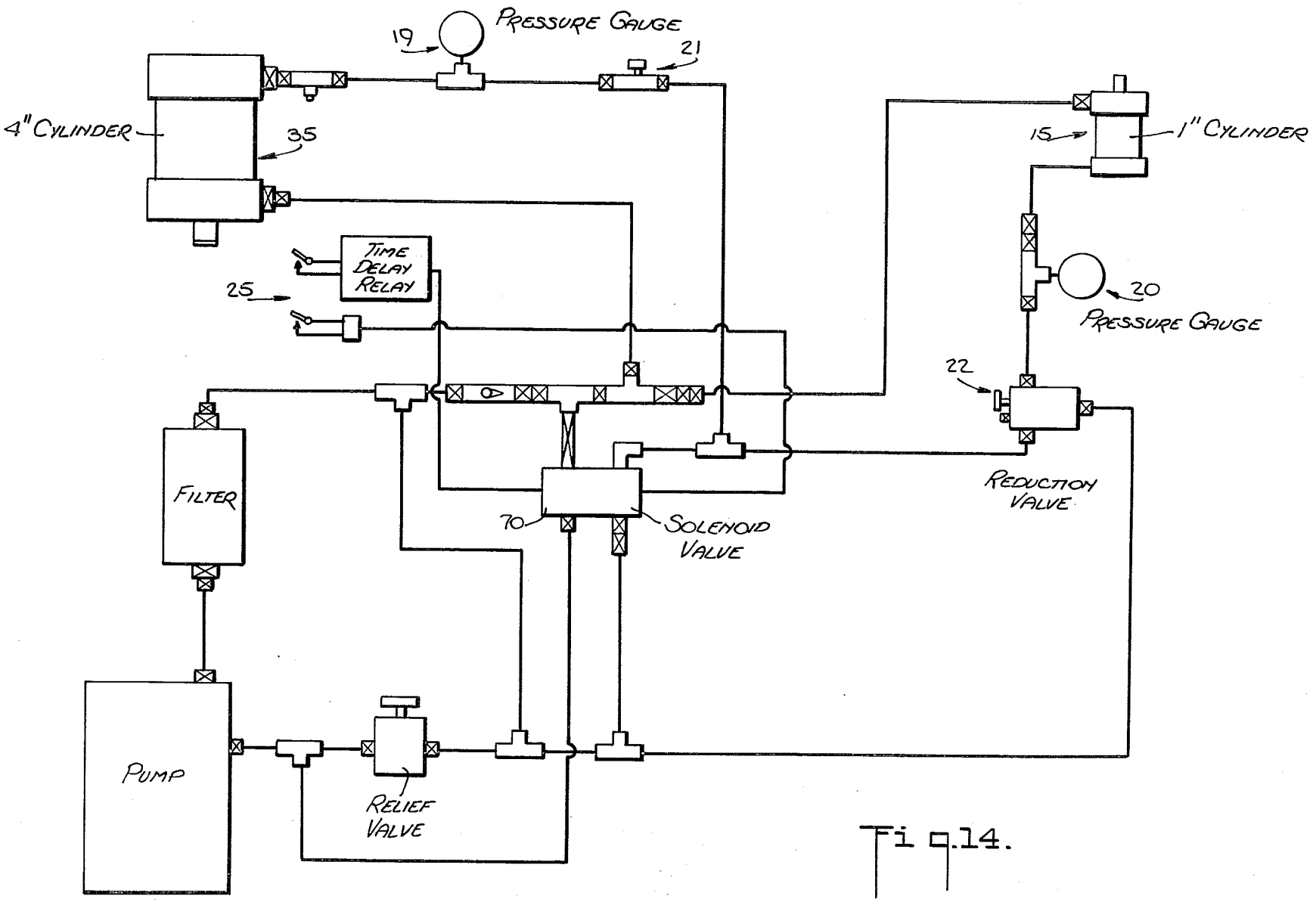
FIG. 14 is a schematic illustration of the hydraulic control system.

FIG. 14 illustrates the fluid power circuit for coordination of the actuation of the cylinders 15 and 35. The pressure gauges 19 and 20 and the pressure control valves 21 and 22 for the cylinders are also shown. It will be seen that there is a solenoid valve 70 controlled through the aforementiond time delay relay circuit by the depth stop device 25. The solenoid valve 70 controls the flow of hydraulic fluid from the pump to the cylinders 15 and 35. The smaller diameter cylinder 15 requires less fluid for actuation and is accordingly more quickly responsive than the larger cylinder 35. Thus the cylinder 15 will move the pipe P up to its proper position for grooving before the ram housing 32 has fully descended.

The electrical circuit schematically shown is, of course, merely illustrative of one kind of suitable circuit for control of the solenoid valve 70. It will be clear to those skilled in the art that there are various kinds of electrical switching and relay devices, suited to the nature of the solenoid valve used. The function of the system of FIG. 14 is to provide fluid to the cylinder 35 during its downward grooving stroke while simultaneously actuating the cylinder 15, then at the signal from the depth stop device 25 to stop further downward motion of the cylinder 35 while maintaining its position, and finally after the selected dwell period, to actuate the cylinder 35 to move upwards, retracting the grooving roll 12.

SAFETY ACTION

The ram 11 should not be actuated into downward movement when there is no pipe between the rolls 12 and 13. Unless some safety device were provided, such operation of the machine without a pipe in place could cause damage to the rolls 12 and 13. To prevent such damage, the photocell 26 and light beam source 27 are provided to permit downward movement of the ram 11 only when the beam of light passing upward from the source 27 to the cell 26 is blocked. This positive safety feature is illustrated in FIGS. 1 and 4.

Various modifications and adaptations of the machine and its several features will suggest themselves to those familiar with the machining of pipe, and are considered to be within the spirit and scope of the invention.

What is claimed is:

1. In a machine for rolling a circumferential groove in a pipe, of the type having a freely rotating grooving roll and a driven backup roll, hydraulic ram means for forcing said grooving roll downward against a pipe on said backup roll, vibration limiting means comprising a fluid actuated piston and cylinder coupled to means for supporting the pipe at a slight angle with respect to the axis of rotation of said backup roll, said hydraulic ram means and said fluid actuated piston being coordinated by a fluid circuit.

2. The machine of claim 1 wherein said fluid actuated piston is mounted for vertical movement of the means for supporting the pipe.

3. The machine of claim 1 and including automatic depth stop means for sensing the depth of a groove and means associated with said depth stop means for retracting the grooving roll away from the pipe after a predetermined dwell period.

4. The machine of claim 1 and including a safety device comprising a photocell mounted to sense the presence of a pipe in grooving position and to prevent operation of the machine when no pipe is in such grooving position.

5. The machine of claim wherein the means for supporting the pipe at a slight angle with respect to the axis of rotation of the backup roll includes a pair of pipe supporting idler rolls mounted on opposite sides of a generally V-shaped recess in a plate, one of said idler rolls being slightly larger in diameter than the other of said idler rolls.

6. The machine of claim 5 wherein the plate on which said idler rolls are mounted is vertically movable by means of the fluid actuated piston and cylinder of said vibration limiting means.

7. The machine of claim 5 wherein there are at least two pairs of said idler rolls for supporting pipes of different outside diameters.

8. A machine for forming an external circumferential groove in a pipe comprising a backup roll mounted in driven relationship with a motor, a grooving roll mounted for vertical movement toward said backup roll, hydraulically actuated ram means for forcing said grooving roll downward against a pipe to roll a groove in the pipe, said ram means also being operative to retract said grooving roll upwards upon completion of grooving, vibration damping means comprising a hydraulic cylinder and piston less powerful than and opposed to said ram means whereby excess loads on said grooving and backup rolls caused by irregularities in the pipe being grooved are cushioned by yielding of said cylinder and piston.

9. The machine of claim 8 wherein the piston of said vibration damping means is secured to a vertically movable plate, said plate carrying at least one pair of pipe supporting idler rolls.

10. The machine according to claim 9 wherein said idler rolls are of such size and position as to cause a pipe supported by a pair of idler rolls to be presented at a slight angle with respect to the axis of rotation of the backup roll.

11. The machine according to claim 8 and including means for regulating the force and speed of said hydraulically actuated ram means.

12. The machine according to claim 8 and including automatic depth stop means cooperating with said ram means for stopping downward movement of said grooving roll when a groove of the desired depth has been achieved.

13. The machine according to claim 12 wherein said automatic depth stop means includes an adjustably mounted switch and a bar mounted on said ram means for vertical movement therewith to activate said switch when the ram has descended to a position corresponding to a groove depth preset by adjustment of the position of said switch.

14. In a machine for rolling a circumferential groove in a pipe, of the type having a freely rotating grooving roll and a driven backup roll, vibration limiting means comprising fluid actuated piston and cylinder coupled to means for supporting the pipe at a slight angle with respect to the axis of rotation of said backup roll and including a safety device comprising a photocell mounted to sense the pressure of a pipe in grooving position and to prevent operation of the machine when no pipe is in such grooving position.

* * * * *

UNITED STATES PATENT AND TRADEMARK OFFICE

CERTIFICATE OF CORRECTION

PATENT NO. : 3,995,466

DATED : December 7, 1976

INVENTOR(S) : Donald R. Kunsman

It is certified that error appears in the above-identified patent and that said Letters Patent are hereby corrected as shown below:

Column 1, line 66 "present" should be --preset--

Column 2, line 22 "circumference" should be --circumferential--

Column 3, line 59 "beend" should be --been--

Column 4, line 34 "1°" should be --one degree (1°)--

Column 5, line 8 "not" should be --not--

Column 5, line 11 "(2")" should be --two inches (2")--

Column 5, line 12 "1 7/8 inches" should be --one and seven-eighths inches (1 7/8")--

Column 8, line 30, after "of claim" should read --of claim 1--

Column 10, line 9, "pressure" should be --presence--

Signed and Sealed this

Fifth Day of April 1977

[SEAL]

*Attest:*

RUTH C. MASON
*Attesting Officer*

C. MARSHALL DANN
*Commissioner of Patents and Trademarks*